US008215255B2

(12) United States Patent
Wobben et al.

(10) Patent No.: US 8,215,255 B2
(45) Date of Patent: Jul. 10, 2012

(54) SHIP RUDDER AND SHIP PROVIDED THEREWITH

(75) Inventors: Aloys Wobben, Aurich (DE); Rolf Rohden, Aurich (DE); Dirk Holtkamp, Aurich (DE)

(73) Assignee: Aloys Wobben, Aurich (DE)

( * ) Notice: Subject to any disclaimer, the term of this patent is extended or adjusted under 35 U.S.C. 154(b) by 0 days.

(21) Appl. No.: 12/444,573

(22) PCT Filed: Oct. 8, 2007

(86) PCT No.: PCT/EP2007/008704

§ 371 (c)(1),
(2), (4) Date: Mar. 12, 2010

(87) PCT Pub. No.: WO2008/043504

PCT Pub. Date: Apr. 17, 2008

(65) Prior Publication Data

US 2010/0186648 A1 Jul. 29, 2010

(30) Foreign Application Priority Data

Oct. 6, 2006 (DE) ..... 10 2006 047 755

(51) Int. Cl.
*B63H 25/38* (2006.01)
*B63B 3/44* (2006.01)

(52) U.S. Cl. ..... 114/162; 114/140; 114/142

(58) Field of Classification Search ..... 114/39.15, 114/39.24, 127–143, 149, 152, 162–172; 440/66–70

See application file for complete search history.

(56) References Cited

U.S. PATENT DOCUMENTS

| | | | | | |
|---|---|---|---|---|---|
| 1,714,042 | A | * | 5/1929 | Oertz | 114/162 |
| 1,744,138 | A | * | 1/1930 | Oertz | 114/162 |
| 1,844,303 | A | * | 2/1932 | Wagner | 114/162 |
| 1,973,783 | A | * | 9/1934 | Thorsen | 114/162 |
| 2,331,706 | A | * | 10/1943 | Livingston | 114/162 |
| 2,392,165 | A | * | 1/1946 | Livingston | 114/162 |
| 2,705,469 | A | * | 4/1955 | Kohnenkamp | 440/66 |
| 5,415,122 | A | | 5/1995 | Shen | |
| 5,456,200 | A | * | 10/1995 | Shen | 114/162 |

FOREIGN PATENT DOCUMENTS

| | | | | |
|---|---|---|---|---|
| DE | 19844353 | A1 | * | 3/2000 |
| DE | 101 03 137 | A1 | | 7/2002 |
| GB | 174021 | | | 1/1922 |
| GB | 1131611 | | | 10/1968 |
| GB | 1261998 | | | 2/1972 |
| JP | 57007798 | A | * | 1/1982 |
| JP | 59137294 | A | * | 8/1984 |
| JP | 2005306355 | A | * | 11/2005 |
| NL | 6410681 | | | 3/1966 |
| WO | 0107314 | A3 | | 2/2001 |
| WO | WO 0107314 | A2 | * | 2/2001 |

OTHER PUBLICATIONS

PCT International Search Report from counterpart PCT/2007/008704, 14 pages.
English Translation of Written Opinion, mailed Jun. 10, 2009, for PCT/EP2007/008704, 11 pages.

* cited by examiner

*Primary Examiner* — Ajay Vasudeva
(74) *Attorney, Agent, or Firm* — Seed IP Law Group PLLC

(57) ABSTRACT

A twisted rudder blade for a ship having a twist that is adapted to the configuration of the flow of the water in the region of the rudder blade if no propeller in operation is disposed in front of the rudder blades in the direction of travel of the ship.

7 Claims, 4 Drawing Sheets

SHIP RUDDER AND SHIP PROVIDED THEREWITH

BACKGROUND

1. Technical Field

The present invention concerns a rudder blade for a ship and a ship having at least one rudder blade according to the invention.

2. Description of the Related Art

If the flow along the hull of a ship as it moves is considered, it can then be clearly seen that, at a tapering stern of the ship, the flow does not extend exactly parallel to the line of the keel of the ship but follows the configuration of the stern of the ship.

A rudder of conventional design, that is to say expressed in simple terms a flat plate, which is mounted laterally displaced from the line of the keel in the stern region of the ship and is oriented in the zero-degree position exactly parallel to the line of the keel would therefore have an afflux flow thereagainst at an inclined angle and thus gives rise to a flow resistance. That flow resistance signifies higher fuel consumption and thus a higher level of environmental pollution or with the same fuel consumption or the same engine power a low speed and thus a longer travel time and thus in turn higher fuel consumption and more severe environmental pollution.

It is known from U.S. Pat. No. 5,415,122 for a rudder blade to be adapted to a propeller-generated flow. In that case the flow directions produced by the propeller are taken into consideration and the rudder suitably adapted in a multiplicity of profiles in the chord direction. For example, Table 1 of that publication specifies a reduction in an angle of the rudder blade with an increasing height (Y-position) of the respective profile, starting from the axis of the propeller disposed in front thereof. That specific configuration of a rudder blade also takes in account the effects due to turbulence due to the rudder.

BRIEF SUMMARY

According to various embodiments of the present invention a rudder blade is provided, which is particularly advantageous in terms of flow, for mounting in the region of the stern of a ship laterally beside the keel line.

The rudder blade is twisted in itself, wherein the twisting is adapted to the configuration of the flow of the water at the stern of the ship, that is to say in the region of the mounting location of the rudder blade. In this respect, the rudder blade is twisted inwardly towards the keel line of the ship. The advantages of these rudder blades are higher efficiency for the rudder blades, which leads to smaller rudder blades, and also an improved afflux flow in respect of the propeller (insofar as there is one).

As the flow (at any event at the surface of the water) exactly follows the configuration of the hull in the stern region of the ship, the precise angle of incidence of the rudder blade at its upper region (the end towards the hull) is naturally dependent on the geometrical configuration of the stern. The twisting gradually decreases towards the lower region of the rudder blade (the end remote from the hull of the ship).

In accordance with one embodiment, a ship is provided having at least one twisted rudder blade arranged for controlling the ship, wherein the twist of the blade is adapted to the configuration of the flow of the water in the region of the rudder blade if no propeller in operation is disposed in front of the rudder blade in the direction of travel of the ship. Therefore the rudder blade is adapted to the flow of the water relative to the ship, wherein that flow is not generated by a propeller mounted in front thereof.

DETAILED DESCRIPTION

Figure 1:
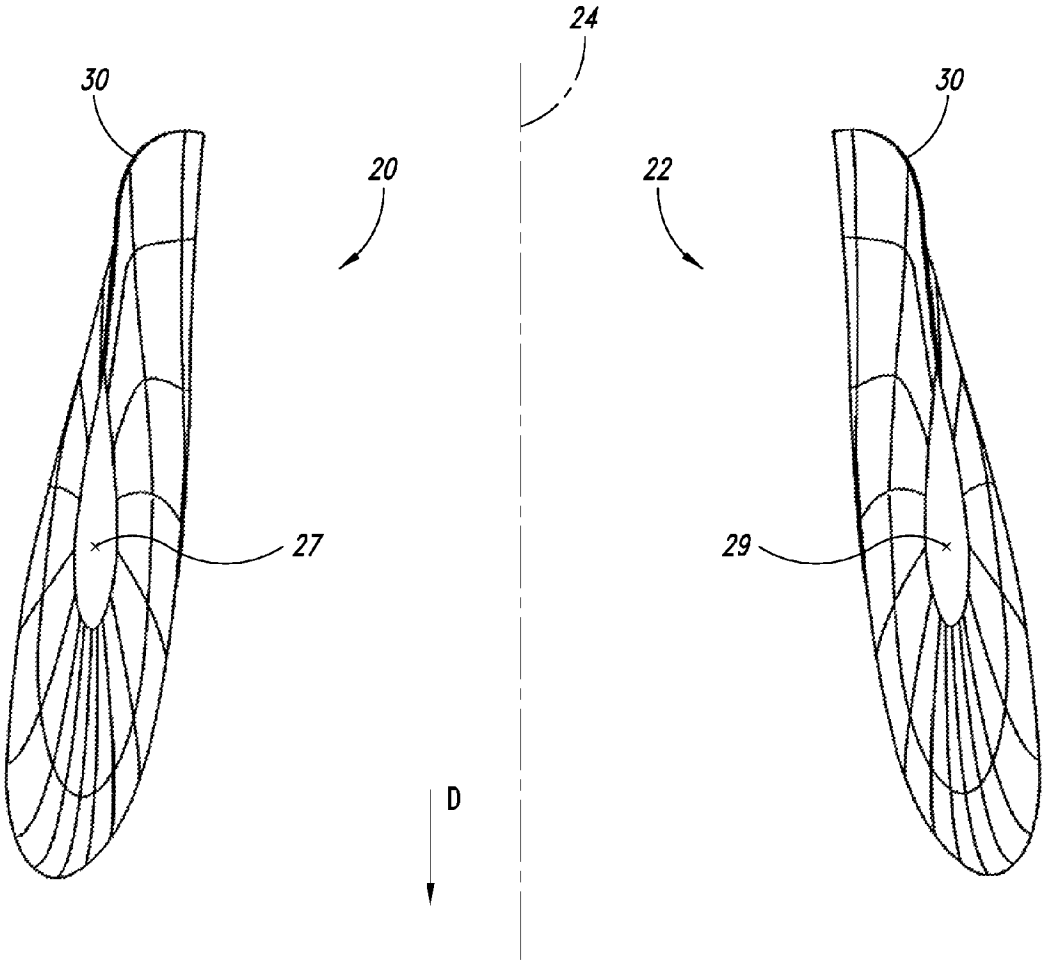
FIG. 1 is a bottom view of two rudder blades according to one embodiment.

FIG. 1 shows two rudder blades 20, 22 from the perspective of looking up from below a ship 10 (shown in FIG. 3) such that a keel line 24 of the ship 10 would be seen between the rudder blades 20, 22. There is a twist at the trailing edge 30 of the rudder blades 20, 22 as shown in this figure.

Figure 2:
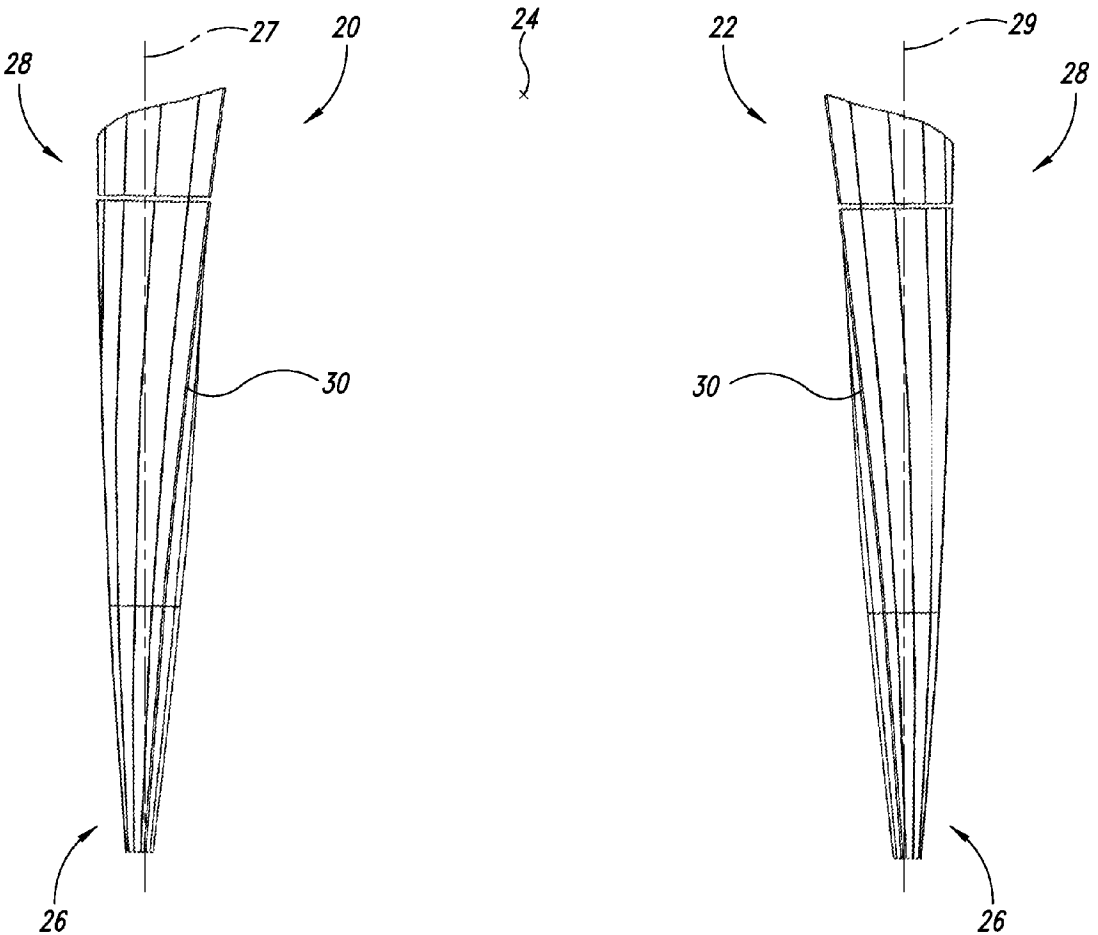
FIG. 2 is a rear view of two rudder blades according to one embodiment.

FIG. 2 shows two rudder blades 20, 22 from the perspective of looking at the stern of a ship 10 (shown in FIG. 3) from behind the ship 10. The twist present in the trailing edge 30 is shown. The trailing edge 30 also rotates as it extends from a lower region 26 to an upper region 28. Both rudder blades 20, 22 have the twist in a direction that is toward the center keel line 24 of the ship 10. Each rudder blade has a longitudinal axis 27, 29 respectively.

Figure 3:
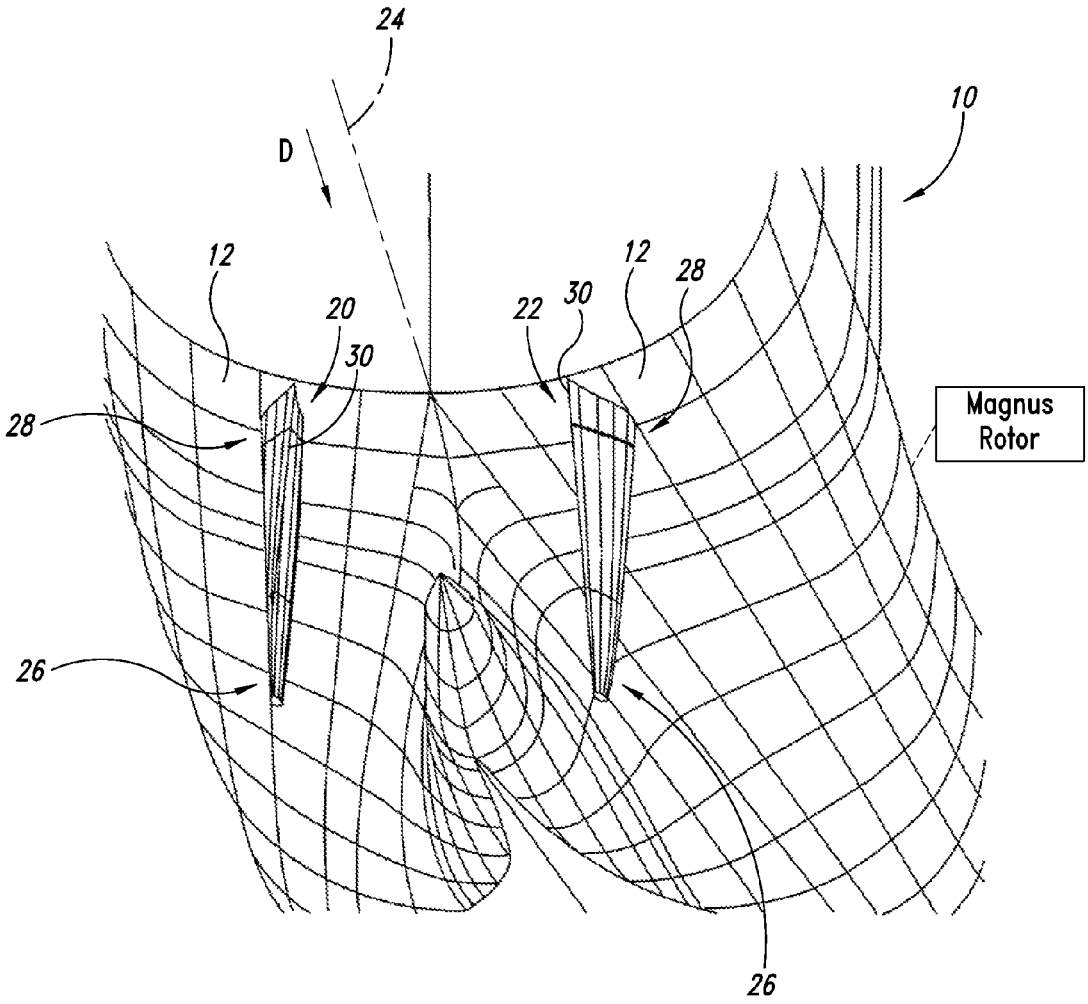
FIG. 3 is a perspective view of two rudder blades of a ship according to one embodiment.

FIG. 3 shows a perspective view of a stern of a ship 10, the ship 10 having two rudder blades 20, 22. The port (left) rudder blade 20 is twisted towards the right, that is to say towards the keel line 24, while the starboard (right) rudder blade 22 is twisted to the left, that is to say also towards the keel line 24. The angle of incidence or the twist angle of each rudder blade 20, 22 decreases with increasing distance from the hull 12. In the illustrated embodiment, the angle of incidence does not reach zero degrees at the lower end or region 26 (the end remote from the hull 12) of the rudder blade 20, 22, but involves an angle of 2 degrees.

Figure 4:
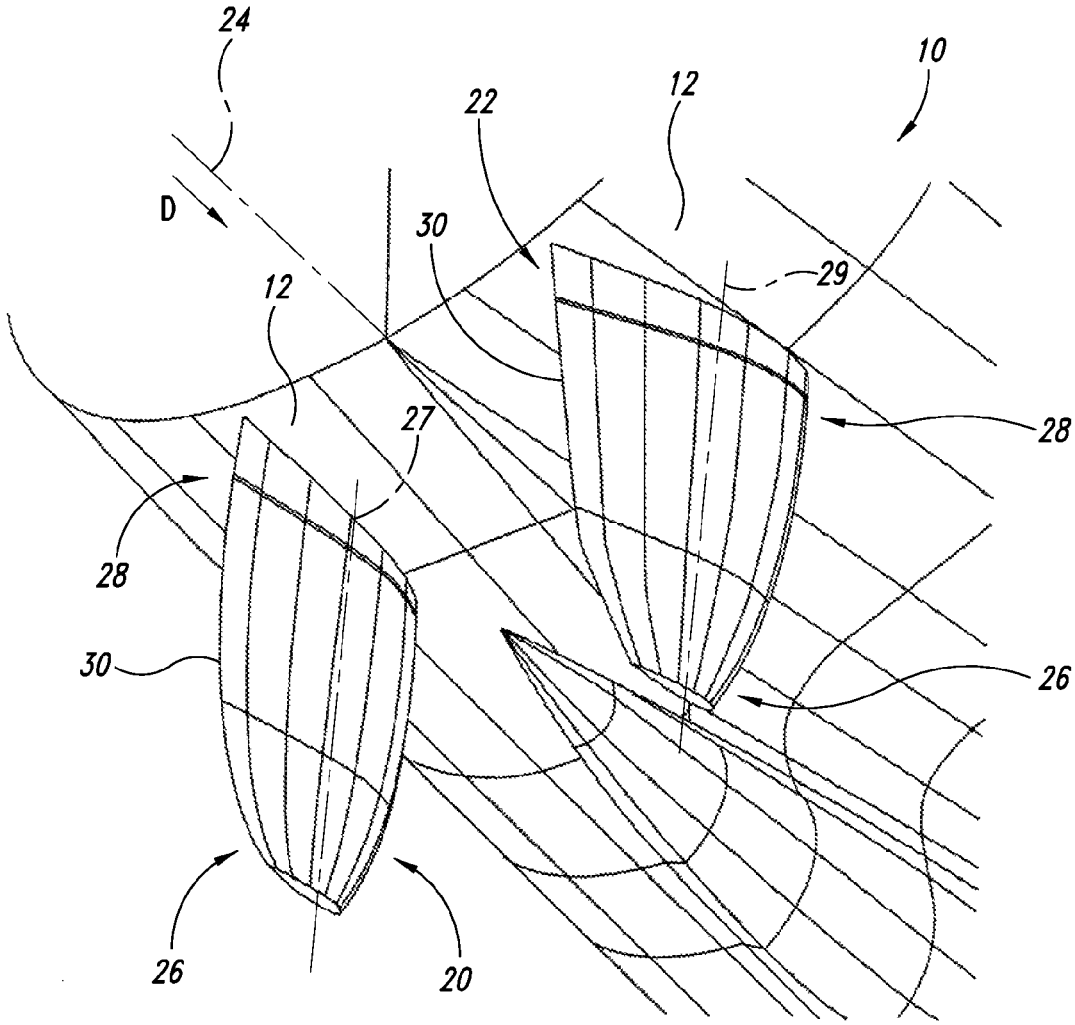
FIG. 4 is a perspective view of two rudder blades of a ship according to one embodiment.

FIG. 4 shows another perspective view of a stern of a ship 10, the ship 10 having two rudder blades 20, 22 which are arranged on both sides laterally beside the keel line 24 of the ship 10. One of the rudder blades 20 is arranged at the left, that is to say on the port side of the keel line 24, while the second rudder blade 22 is arranged at the right, that is to say at the starboard side of the keel line 24. Whether the ship 10 is a pure sailing ship, as the present figure indicates, or whether there is also at least one propeller with a further rudder blade (for example aligned with the keel line) is immaterial since the invention is useful with either sailing ships or propeller driven ships.

It can be appreciated from FIGS. 3 and 4 that there is no propeller in front of the rudder blades 20, 22. No propeller at all is present in the illustrated embodiment.

With reference to the accompanying figures and according to one embodiment, a rudder blade 20, 22 is twisted in its upper region 28 (near the hull 12) through about 10 degrees while in its lower region 26 (remote from the hull 12) it is twisted through about 2 degrees. The amount of twist is a measure of the angle difference between the chord of the rudder blade 20, 22 and the keel line 24. Those values were ascertained on the specific example of a predetermined hull shape firstly by simulation and then empirically. Since, as mentioned hereinbefore, the twist is dependent on the hull geometry, a twist of up to 20 degrees is not unrealistic in the region of the rudder blade near the hull 12 (the upper region 28). Ranges of twist up to 5 degrees can certainly be considered in the lower region 26 (remote from the hull 12). It is to be borne in mind, however, that that twist must always be in relation to the keel line 24, that is towards the hull center. The rudder blade 20, 22 is therefore always twisted inwardly.

In accordance with another embodiment of the invention there is proposed a ship 10 having at least one twisted rudder blade 20, 22 arranged for controlling the ship 10, wherein the twist of the blade 10 is adapted to the configuration of the flow of the water in the region of the respective rudder blade 20, 22 if no propeller in operation is disposed in front of the rudder blades 20, 22 in the direction of travel D of the ship 10. Therefore the rudder blade 20, 22 is adapted to the flow of the water relative to the ship 10, wherein that flow is not generated by a propeller mounted in front thereof. Rather, it is the flow resulting from the movement of the ship 10 through the water that is primarily of significance. Other flows are not taken into consideration or do not occur. In accordance with an aspect therefore no propeller is disposed in front of the rudders 20, 22. If a propeller is to be disposed at an upstream position in another embodiment, the propeller is not in operation. In other words, it is not driven but is, for example, in an idle condition.

In accordance with an embodiment, there are at least two rudder blades 20, 22 which are provided laterally displaced with respect to the keel line 24, wherein the twisting of the blade is adapted to the configuration, caused by the geometry of the hull 12, of the flow of the water in the region of the respective rudder blade 20, 22. The movement of the ship through the water affords relative to the ship 10 a flow which in terms of its magnitude approximately corresponds to the speed of the ship 10 through the water. The specific configuration of the flow is determined primarily by the geometry of the hull 12 of the ship 10, insofar as it is in the water. The rudder blades 20, 22 are adapted to that flow.

The term twisting of the rudder blade is used to denote rotational displacement of the rudder blade 20, 22 about a longitudinal axis 27, 29 thereof. The respectively specified twist angles are however specified as the angle of the chord of the rudder blade at a respective height relative to the keel line 24 and can also be referred as the angle of incidence.

In accordance with one embodiment, the rudder blades 20, 22 have an angle of incidence relative to the keel line 24 so that the respective rudder blade 20, 22 faces towards the keel line 24 in the direction of flow in forward movement of the ship. Due to the hull shape converging rearwardly towards the stern, and if the rudders are arranged as usual in the stern region of the ship 10, the flow of the water also converges rearwardly—relative to the ship 10—when the ship 10 is making headway through the water. This embodiment takes account of that effect. Accordingly, when traveling straight-ahead, the rudder blades 20, 22 face towards the keel line 24 and thus towards the center of the ship.

In accordance with an embodiment, the angle of incidence relative to the keel line 24 of the respective rudder blade 20, 22 decreases with increasing distance from the hull 12 of the ship 10. The rudder blade 20, 22 is accordingly so twisted that, in the proximity of the hull 12, there is a greater angle of incidence which then decreases with increasing distance from the hull 12 of the ship 10.

In accordance with an embodiment, the angle of incidence or the twist angle is between 2 degrees and 20 degrees. In that respect the greater value is usually in the proximity of the ship's hull 12 and the smaller value is at the lower end or region 26 of the rudder blade 20, 22. For example, the angle of incidence can drop from 20 degrees at the hull 12 or in the proximity of the hull 12 to 5 degrees at the lower end or region 26, or in another example from 10 degrees to 2 degrees.

In accordance with another embodiment, the angle of incidence or twist angle in the region 28 near the hull 12 is between 10 degrees and 20 degrees and in the region 26 remote from the hull 12 it is between 2 degrees and 5 degrees.

According to one embodiment, two rudders 20, 22 are respectively arranged symmetrically on the two sides of the keel line 24. Accordingly, one rudder 22 is at the right in the direction of travel D and thus at the starboard side of the ship 10 and a counterpart thereto is on the opposite side of the keel line 24, but otherwise at the same location. Such two rudders 20, 22 are preferably also of a mutually symmetrically configuration, namely of a mirror-image symmetrical configuration.

According to another embodiment, at least one Magnus rotor (not shown) is provided as the drive for the ship 10. Such a Magnus rotor generates forward propulsion for the ship 10 utilizing the Magnus effect. For example, use is made of a cylinder which stands vertically and which rotates at high speed and around which the wind flows. Depending on the respective wind direction and direction of rotation, the result is forward propulsion for the ship 10. Accordingly, there is no drive by propeller movement and the flow of the water in the hull region is directed substantially in accordance with the movement of the ship 10 through the water and the flow profile is determined by the geometry of the ship's hull 12. The rudder blades 20, 22 are correspondingly designed. Further advantageous effects can also occur if other kinds of drive systems are used, which do not or do not substantially engage into the flow of the water in the hull region. In accordance with one embodiment of the invention, a propeller can also be provided, for example, as auxiliary propulsion. In that case, however, the design of the rudder blade or blades 20, 22 is preferably implemented when the propeller is not driven, for example, when the propeller is in the idle condition.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A ship comprising:

a hull having a stern portion with sides that converge toward a keel line of the ship; and a pair of twisted rudder blades arranged for steering the ship, the rudder blades coupled to the stern portion of the ship with one twisted rudder blade positioned on each side of the keel line, and each twisted rudder blade having a twist that varies over a height thereof to align with a converging flow of water in a region of the twisted rudder blade generated by a geometry of the sides of the ship when the ship travels through the water in a forward direction, an angle of the twist of each blade varying progressively in the same direction between an upper end of the rudder blade near the hull and a lower end of the rudder blade remote from the hull, and in which a chord line of a cross-sectional profile of each of the twisted rudder blades at any height is directed from a leading edge of the rudder blade to a trailing edge of the rudder blade in a direction toward the keel line of the ship.

2. A ship according to claim 1 wherein the angle of the twist of each rudder blade relative to the keel line decreases with an increasing distance from the hull of the ship.

3. A ship according to claim 1 wherein the angle of the twist of each rudder blade relative to the keel line is between 2 degrees and 20 degrees over the height of the rudder blade.

4. A ship according to claim 1 wherein the angle of the twist of each rudder blade is between 10 degrees and 20 degrees in a region near the hull of the ship and between 2 degrees and 5 degrees in a region remote from the hull such that each rudder blade twists at least 5 degrees and less than 18 degrees over the height thereof.

5. A ship according to claim 1 wherein the pair of twisted rudder blades are respectively arranged symmetrically on opposite sides of the keel line.

6. A ship according to claim 1, further comprising:

at least one Magnus rotor coupled to the ship to receive a flow of air and drive the ship.

7. A ship comprising:

a hull having a stern portion with sides that converge toward a keel line of the ship; and two twisted rudder blades, each rudder blade positioned at the stern portion of the ship offset from the keel line and having a twist that varies progressively in the same direction over a height thereof between a region of the rudder blade near the hull and a region of the rudder blade remote from the hull, and an angle of incidence of each rudder blade relative to the keel line defined by a chord line of the rudder blade at a respective height being between 10 degrees and 20 degrees in the region near the hull of the ship and between 2 degrees and 5 degrees in the region remote from the hull of the ship such that each rudder blade twists at least 5 degrees and less than 18 degrees over the height thereof, and the chord line of the rudder blade at any height being directed from a leading edge of the rudder blade to a trailing edge of the rudder blade in a direction toward the keel line.

* * * * *